US008030590B2

(12) United States Patent
Yoshida et al.

(10) Patent No.: US 8,030,590 B2
(45) Date of Patent: Oct. 4, 2011

(54) GAS-CIRCUIT BREAKER

(75) Inventors: Daisuke Yoshida, Tokyo (JP); Yuji Yoshitomo, Tokyo (JP); Haruhiko Kohyama, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 668 days.

(21) Appl. No.: 11/882,103

(22) Filed: Jul. 30, 2007

(65) Prior Publication Data

US 2008/0203061 A1 Aug. 28, 2008

(30) Foreign Application Priority Data

Feb. 27, 2007 (JP) ..... 2007-047908

(51) Int. Cl.
*H01H 33/88* (2006.01)

(52) U.S. Cl. ..... 218/61; 218/57; 218/59

(58) Field of Classification Search ..... 218/51–57, 218/59–64, 67, 68, 72, 73
See application file for complete search history.

(56) References Cited

U.S. PATENT DOCUMENTS 4,459,447 A * 7/1984 Arimoto ..... 218/56
4,556,767 A * 12/1985 Egli et al. ..... 218/59
4,598,188 A * 7/1986 Schotzau et al. ..... 218/59
4,935,590 A * 6/1990 Malkin et al. ..... 218/57
5,723,840 A * 3/1998 Bojic et al. ..... 218/60

FOREIGN PATENT DOCUMENTS

JP 01-313828 A 12/1989
JP 3-245431 A 11/1991
JP 7-109744 B2 11/1995

OTHER PUBLICATIONS

Partial English translation of Office Action mailed Aug. 16, 2011 in corresponding Japanese Patent Application No. 2007-047908.

* cited by examiner

*Primary Examiner* — Renee Luebke
*Assistant Examiner* — Marina Fishman
(74) *Attorney, Agent, or Firm* — Buchanan Ingersoll & Rooney PC

(57) ABSTRACT

A gas-circuit breaker includes a cylinder, a stationary piston, and a moving piston. The cylinder has a moving contact that is fixed on one end of a rod and has a gas exhaust that faces a stationary contact. The rod is inserted into the cylinder. The stationary piston is fixed to the container, and is fitted in an opening of the cylinder to create a puffer chamber. Due to movement of the rod, the stationary piston compresses arc-extinguishing gas, and the gas blows onto the arc through gas exhaust. The moving piston partitions the puffer chamber into a first puffer chamber and a second puffer chamber. Sliding of the moving piston changes the capacity of the first puffer chamber and the second puffer chamber according to the difference in pressure in the first puffer chamber and the second puffer chamber.

2 Claims, 3 Drawing Sheets

GAS-CIRCUIT BREAKER

BACKGROUND OF THE INVENTION

1. Field of the Invention

The present invention is related to a gas-circuit breaker installed in, for example, an electric-power substation and/or a switching station.

2. Description of the Related Art

A conventional gas-circuit breaker includes an arc-extinguishing chamber to extinguish an arc generated between contact. In such an arc-extinguishing chamber, a mechanical puffer is used to mechanically compress an arc-extinguishing gas (hereinafter, "gas") and blow the compressed gas onto an arc. In recent years, a thermal puffer is used in combination with the mechanical puffer to increase the pressure of the gas by using the heat of the arc.

The conventional gas-circuit breaker, in which thermal puffer and mechanical puffer are used together, is disclosed in Japanese Patent Publication No. H07-109744. FIGS. 5 and 6 are a cross sections of the conventional gas-circuit breaker disclosed in Japanese Patent Publication No. H07-109744 in a closed position (current is flowing) state and in an open position (current is interrupted), respectively.

As shown in FIGS. 5 and 6, a gas-circuit breaker is housed in a container 230. The container 230, part of which is shown in the figure, is filled with a gas, for example, sulfur hexafluoride ($SF_6$), used for extinguishing an arc. The gas-circuit breaker includes a stationary contact 210 that is fixed to a first side of the container 230, and a moving contact 220 that is capable of moving linearly on a central axis X, by an operating device (not shown). Because of such a movement, the moving contact 220 is capable of physically contacting or separating from the stationary contact 210.

The stationary contact 210 has a stationary arc-contact 211 arranged on the central axis X. The moving contact 220 includes a moving arc-contact 221, a thermal chamber 222, and a pressure chamber 223. The moving arc-contact 221 moves linearly along the axis X with respect to the stationary arc-contact 211, and it is capable of electrically contacting or separating from the stationary arc-contact 211.

The thermal chamber 222 is located between the moving arc-contact 221 and the pressure chamber 223, and moves linearly on the central axis X along with the moving arc-contact 221 with the operation of a hollow operating rod 224. The pressure chamber 223 is configured of a cylinder 225 that moves linearly along with the moving arc-contact 221 and the thermal chamber 222, and a stationary piston 226 that is supported by the container 230. Due to opening movement of the moving contact 220 (i.e., movement towards right in FIG. 5), the volume of the pressure chamber 223 decreases, whereby the gas inside is compressed.

The thermal chamber 222 has two vents. One vent 222*a* opens towards the moving arc-contact 221 and another vent 222*b* opens in the pressure chamber 223. A check valve 222*c* is located between the thermal chamber 222 and the pressure chamber 223 in the vent 222*b*. The check valve 222*c* opens when the pressure inside the pressure chamber 223 is higher than the pressure in the thermal chamber 222, whereby the gas flows from the pressure chamber 223 into the thermal chamber 222. On the contrary, the check valve 222*c* closes when the pressure in the thermal chamber 222 is higher than the pressure in the pressure chamber 223, thereby preventing flow of gas from the thermal chamber 222 into the pressure chamber 223.

Furthermore, a relief valve 223*a* is located on the stationary piston 226. At the time of current interruption, when the pressure in the pressure chamber 223 increases above a predetermined pressure, the relief valve 223*a* opens. When the relief valve 223*a* opens, the gas inside the pressure chamber 223 flows into the container 230 whereby the pressure in the pressure chamber 223 from increasing above the predetermined pressure.

In closed position (i.e., when current is flowing), the stationary contact 210 and the moving contact 220 are in electrical contact, so that current flows between the stationary contact 210 and the moving contact 220. At the time of current interruption, the moving contact 220 moves to the right in FIG. 5, separates from the stationary contact 210, and an arc is formed between the stationary arc-contact 211 and the moving arc-contact 221.

When the interruption current is large, the temperature of the gas in the thermal chamber 222 increases due to heat of the arc, and the gas expands, leading to increased pressure in the thermal chamber 222. If the pressure in the thermal chamber 222 is higher than pressure of compressed gas in the pressure chamber 223, the check valve 222*c* between the thermal chamber 222 and the pressure chamber 223 closes. As the current reduces and becomes closer to 0, the highly pressurized gas in the thermal chamber 222 blows onto the arc that is generated between the stationary arc-contact 211 and the moving arc-contact 221 through the vent 222*a*. Thus, the arc is quenched and electric current is interrupted.

On the other hand, when the interruption current is small, rise in the temperature in the thermal chamber 222 is smaller. As a result, the gas inside the pressure chamber 223 is compressed due to interruption, and the pressure in the pressure chamber 223 is higher than the pressure in the thermal chamber 222. Therefore, the check valve 222*c* between the thermal chamber 222 and the pressure chamber 223 opens. As a result, the highly pressurized gas in the pressure chamber 223 passes through the thermal chamber 222 and the vent 222*a*, and blows onto an arc that is generated between the stationary arc-contact 211 and the moving arc-contact 221 so that the current is interrupted.

Thus, in the conventional technology, large current interruption performance depends on the capacities of the thermal chamber 222 and the pressure chamber 223. Because it is necessary to locate the thermal chamber 222 between the moving arc-contact 221 of the moving contact 220 and the pressure chamber 223, it is necessary to secure space between the stationary contact 210 and the stationary piston 226 proportionate to the capacity of the thermal chamber 222, in addition to the operation stroke of the moving contact 220.

Therefore, when the capacity of the thermal chamber 222 is increased along with the increase in the interruption current, the gas-circuit breaker becomes lengthy along the axis, and it is not possible to downsize the gas-circuit breaker. Furthermore, when the interruption current is smaller, even if the capacity of the pressure chamber 223 is reduced, space in the thermal chamber 222 becomes a dead space, and pressure of the gas cannot be increased.

SUMMARY OF THE INVENTION

It is an object of the present invention to at least partially solve the problems in the conventional technology.

According to an aspect of the present invention, a gas-circuit breaker that extinguishes an arc that is generated at a contact upon current interruption by blowing arc-extinguishing gas on the arc that is held in a container includes a stationary contact that includes a stationary arc-contact and that is fixed to a first side of the container; a moving rod that extends towards a second side of the container; and a moving contact that is arranged on one end of the moving rod so that the moving contact faces the stationary contact, and includes a moving arc-contact that electrically contacts and separates from the stationary arc-contact due to movement of the moving rod. The moving contact includes a cylinder that is fixed to the one end of the moving rod, and includes a gas exhaust on one side that is facing the stationary contact, and an opening on another side, the moving rod being inserted in the cylinder; a stationary piston that is fitted into the opening of the cylinder and fixed on the second side of the container, creates a puffer chamber inside the cylinder, and compresses gas inside the puffer chamber to blast out the gas due to movement of the moving rod from the gas exhaust towards the arc; and a moving piston that is fitted in the puffer chamber and divides the puffer chamber into a first puffer chamber and a second puffer chamber on stationary piston side, and slides according to a difference in pressure in the first puffer chamber and the second puffer chamber.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
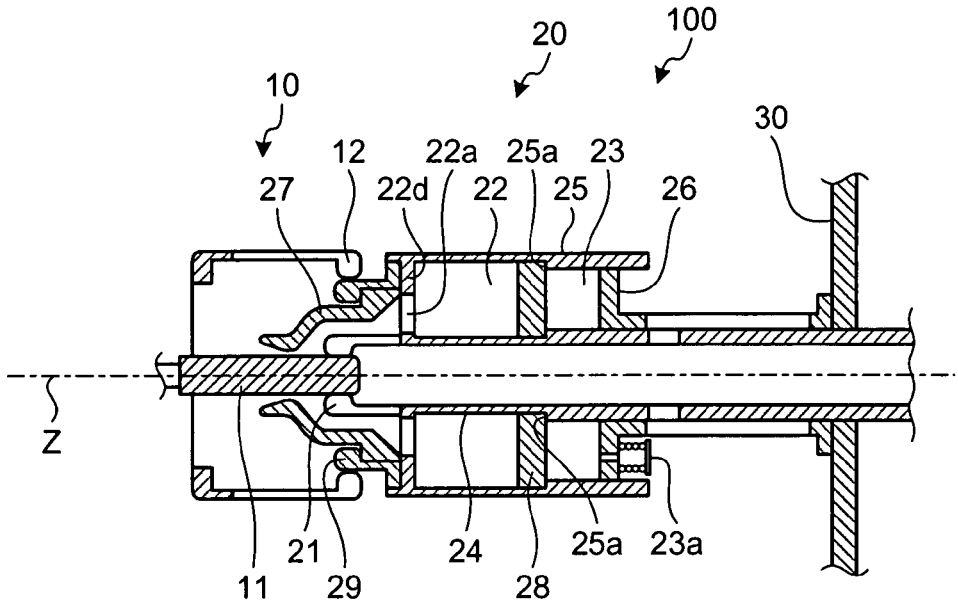
FIG. 1 is a cross section of a gas-circuit breaker in closed position according to an embodiment of the present invention.
Figure 2:
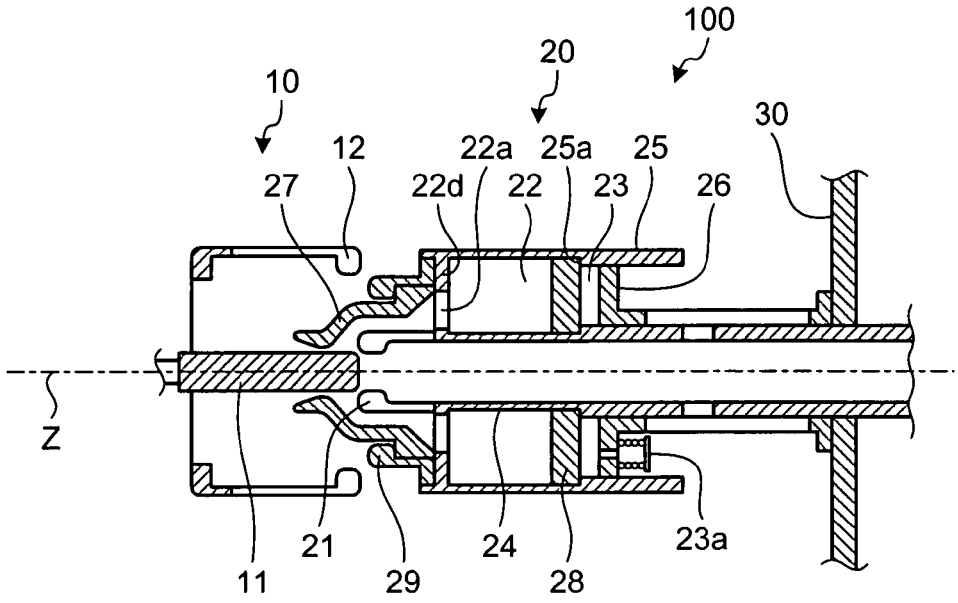
FIG. 2 is a cross section of the gas-circuit breaker upon large current interruption.
Figure 3:
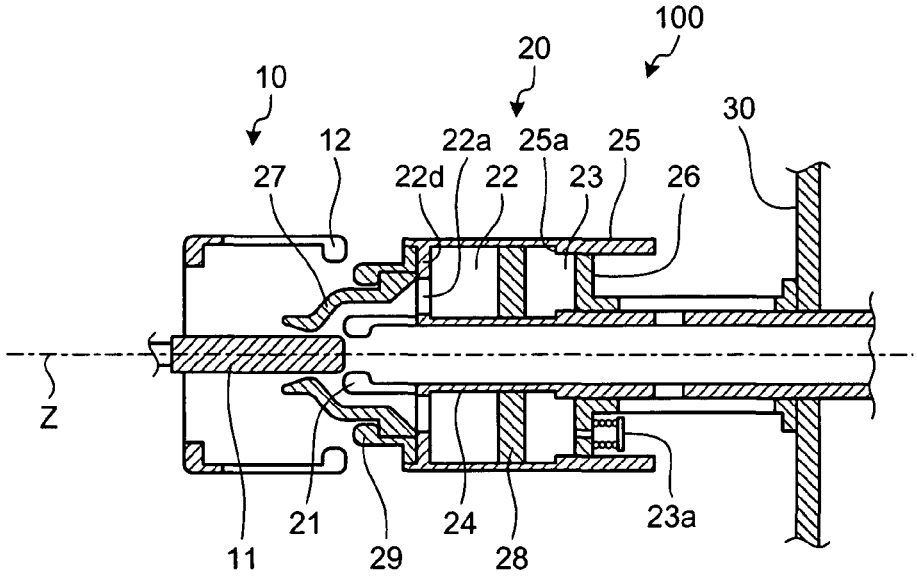
FIG. 3 is a cross section of the gas-circuit breaker upon small current interruption.
Figure 4:
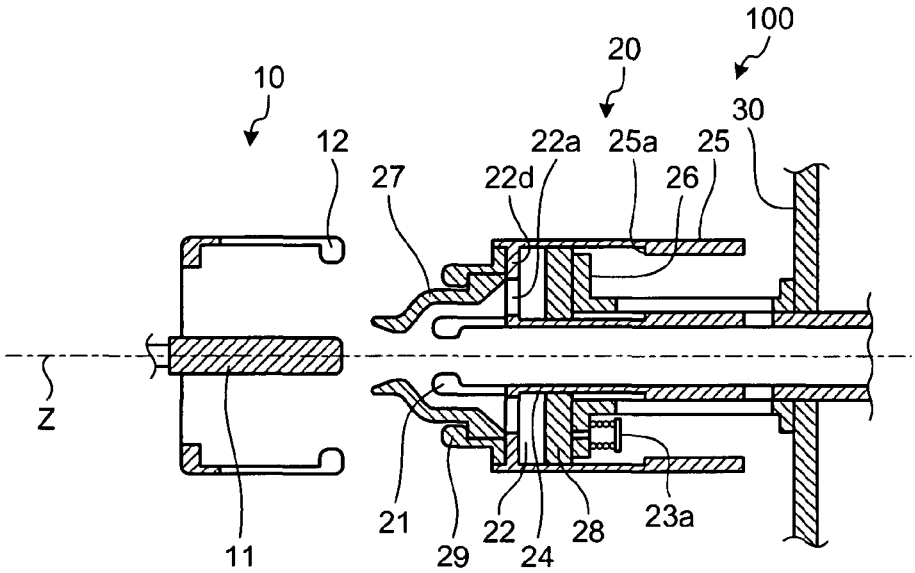
FIG. 4 is a cross section of the gas-circuit breaker in open position.
Figure 5:
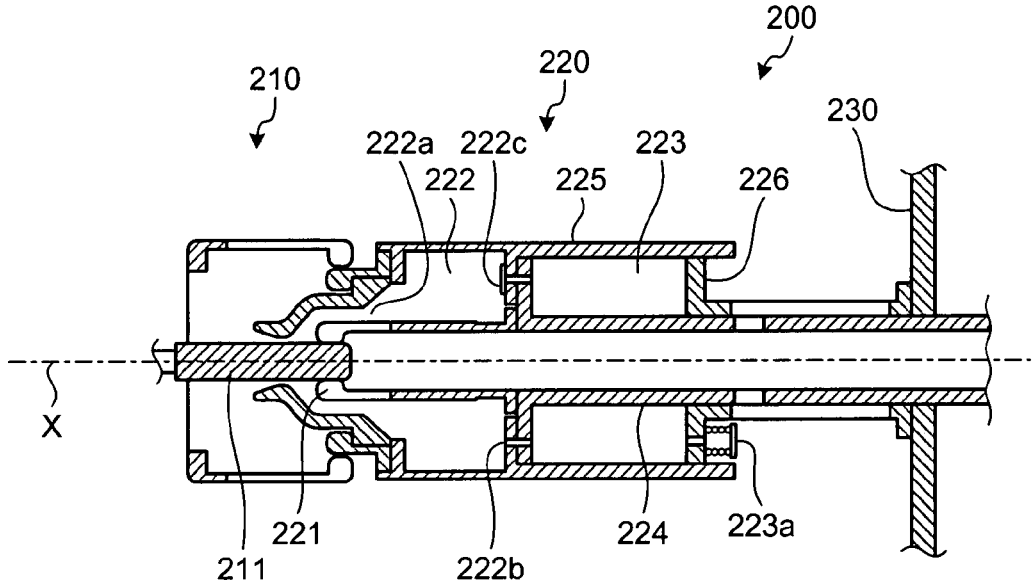
FIG. 5 is a cross section of a conventional gas-circuit breaker in closed position.
Figure 6:
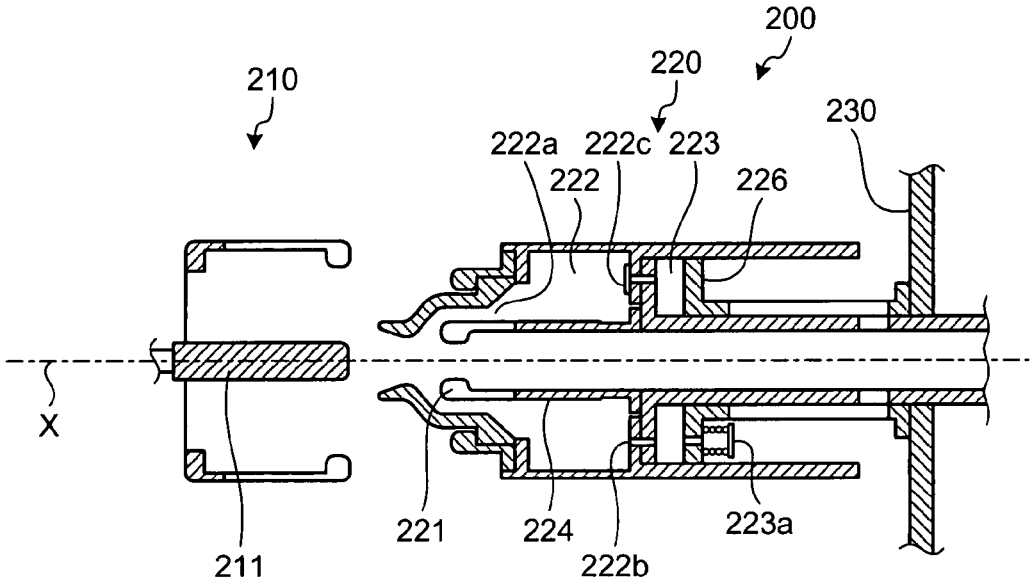
FIG. 6 is a cross section of the conventional gas-circuit breaker in open position.

FIG. 1 is a cross section of a gas-circuit breaker 100, in closed position, according to an embodiment of the present invention. FIG. 2 is a cross section of the gas-circuit breaker 100 upon large current interruption. FIG. 3 is a cross section of the gas-circuit breaker 100 upon small current interruption. FIG. 4 is a cross section of the gas-circuit breaker 100 in open position.

As shown in FIGS. 1 to 4, the gas-circuit breaker (hereinafter "circuit breaker") 100 is housed in a container 30. The container 30, a part of which is shown in the figures, is filled with an arc-extinguishing gas such as $SF_6$. An arc is generated between contacts at the time of current interruption, and the arc is extinguished by blowing the gas on the arc.

The circuit breaker 100 includes a stationary contact 10 that is fixed to a first side (left side in FIG. 1) of the container 30 and a moving contact 20 that is capable of moving linearly on a central axis Z. Because of such a movement, the moving contact 20 is capable of physically contacting or separating from the stationary contact 10. The moving contact 20 is located on a central axis Z. The moving contact 20 is moved along the axial direction by an operating device (not shown) connected to a hollow operating rod 24 that extends out of a second side (right side in FIG. 1) of the container 30.

The stationary contact 10 has a stick-shaped stationary arc-contact 11 located on the central axis Z, and a second stationary main contact 12 that is located away from the central axis Z.

The moving contact 20 includes the hollow operating rod 24, a moving arc-contact 21, and a cylinder 25. The moving arc-contact 21 is fixed to one end of the hollow operating rod 24 and is located to face the stationary contact 10. The moving arc-contact 21 contacts and separates from the stationary arc-contact 11 due to movement of the hollow operating rod 24 in the axial direction. The cylinder 25 is fixed to one end of the hollow operating rod 24. One end of the cylinder 25 is fixed to an end portion 22*d* that includes a gas exhaust 22*a*. The gas exhaust 22*a* faces the stationary contact 10. The cylinder 25 has the hollow operating rod 24 inserted into it that extends to the second side, and the cylinder 25 has an opening on another end.

At the one end of the cylinder 25 is located a moving main contact 29 and an insulation nozzle 27. The moving main contact 29 contacts and separates from the second stationary main contact 12 due to movement of the hollow operating rod 24. The insulation nozzle 27 is a funnel shaped part, with wider mouth part of the funnel shape fixed to the one end of the cylinder 25 and the narrow part of the funnel shape of the insulation nozzle 27 inserted into and fixed to the stationary arc-contact 11. Both the stationary arc-contact 11 and the moving arc-contact 21 are set inside the insulation nozzle 27, and the insulation nozzle 27 becomes an arc extinguishing chamber in which the gas is blasted in from the gas exhaust 22*a*.

A stationary piston 26 fixed at another end of the container 30 is fitted into an opening of the cylinder 25 to create a puffer chamber. When the hollow operating rod 24 moves, the stationary piston 26 compresses the gas inside the puffer chamber and blasts the gas from the gas exhaust 22*a* in the direction of the arc. A moving piston 28 is fitted in the puffer chamber inside the cylinder 25 located between the end portion 22*d* and the stationary piston 26. The moving piston 28 divides the puffer chamber inside the cylinder 25 into a first puffer chamber 22 on the end portion 22*d* side and a second puffer chamber 23 on the stationary piston 26 side. The moving piston 28 slides and capacity of the puffer chamber inside the cylinder 25 is changed depending on the difference between pressure in the first puffer chamber 22 and pressure in the second puffer chamber 23.

In the puffer chamber inside the cylinder 25, a stopper 25*a* is arranged to regulate sliding distance of the moving piston 28 from the end portion 22*d* so that the distance between the end portion 22*d* and the moving piston 28 is not more than a predetermined distance. A relief valve 23*a* is arranged on the stationary piston 26. During the interruption operation of the circuit breaker 100, when the pressure inside the second puffer chamber 23 is more than a predetermined pressure, the relief valve 23*a* opens, exhausts gas from the second puffer chamber 23 into the container 30, and prevents pressure inside the second puffer chamber 23 from being more than a set pressure.

Next, operation of the circuit breaker 100 is explained. In closed position, the stationary contact 10 and the moving contact 20 are in electrical contact with each other because the second stationary main contact 12 contacts with the moving main contact 29, and the stationary arc-contact 11 contacts the moving arc-contact 21. Thus, current flows between the stationary contact 10 and the moving contact 20.

As shown in FIG. 2, when current is applied, the moving contact 20 moves towards a right direction and separates from the stationary contact 10. At such time, at first, the second stationary main contact 12 and the moving main contact 29 separate from each other, and the current flows only in between the stationary arc-contact 11 and the moving arc-contact 21. Subsequently, the stationary arc-contact 11 and the moving arc-contact 21 separate, and the arc is generated between the stationary arc-contact 11 and the moving arc-contact 21.

During large current-interruption, temperature of the gas in the first puffer chamber 22 increases and the gas expands leading to rise in pressure in the first puffer chamber 22. As the pressure rises in the first puffer chamber 22 the moving piston 28 moves in an opposite direction of the moving arc-contact 21, and stops at the stopper 25*a* (see FIG. 2).

Due to the movement of the moving piston 28, volume of the second puffer chamber 23 reduces and the pressure inside the second puffer chamber 23 increases. However, pressure in the first puffer chamber 22 is higher than the pressure in the second puffer chamber 23, the moving piston 28 is pressed against the stopper 25*a*. Consequently, the pressure in the first puffer chamber 22 increases while the capacity thereof is constant. The gas under high pressure in the first puffer chamber 22 is blasted through the gas exhaust 22*a* into the arc-extinguishing chamber, and blows onto the stationary arc-contact 11 and the moving arc-contact 21, quenching the arc, which leads to current interruption. The gas that is blasted into an arc extinguishing chamber formed inside the insulation nozzle 27 and then is exhausted into the container 30 through the hollow operating rod 24.

As shown in FIG. 3, during small current interruption, pressure in the second puffer chamber 23 generated due to mechanical pressure of the stationary piston 26 is more than the pressure in the first puffer chamber 22. Thus, the moving piston 28 moves in the direction of the moving arc-contact 21 and pressurizes the first puffer chamber 22. The gas in the pressurized first puffer chamber 22 blows onto the arc through the gas exhaust 22*a*.

As explained above, in the circuit breaker 100, when the interruption current is large, the first puffer chamber 22 function as thermal puffer chamber. On the contrary, when the interruption current is small, due to mechanical pressure applied by the stationary piston 26 and the moving piston 28 the first puffer chamber 22 functions as mechanical puffer chamber.

Thus, because the first puffer chamber 22 alone fulfills the function of the thermal puffer chamber and the mechanical puffer chamber, the moving contact 20 can be down sized as much as the size occupied by the thermal puffer chamber in the conventional gas-circuit breaker.

The position of the stopper 25*a* in the first puffer chamber 22 can be set such that it allows the maximum capacity in the first puffer chamber 22 required for extinguishing the arc at the time of the large current interruption. When the strength of the interruption current differs, it is possible to handle the situation only by changing the position of the stopper 25*a*. Thus, it is not necessary to change the measurements of the entire circuit breaker.

When the interruption current is small, because it is possible to compress the first puffer chamber 22 without large dead space as required in conventional thermal chamber, it is possible to obtain better performance in case of small current interruption in the circuit breaker.

According to an aspect of the present invention, two parts of a puffer chamber in a conventional technology, i.e., a thermal chamber and a pressure chamber, are consolidated in one part, so that the puffer chamber according to the present invention fulfills the function of the two parts. Thus, the thermal chamber that is necessary in the conventional technology is not necessary in the embodiment so that the gas-circuit breaker can be downsized. Therefore, cost is reduced, and it is possible to obtain the gas-circuit breaker that can yield better performance with respect to all current levels.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A gas-circuit breaker that extinguishes an arc that is generated at a contact upon current interruption by blowing arc-extinguishing gas on the arc that is held in a container, the gas-circuit breaker comprising:

a stationary contact that includes a stationary arc-contact and that is fixed to a first side of the container;

a moving rod that extends towards a second side of the container; and a moving contact that is arranged on one end of the moving rod so that the moving contact faces the stationary contact, and includes a moving arc-contact that electrically contacts and separates from the stationary arc-contact due to movement of the moving rod, wherein the moving contact includes a cylinder that is fixed to the one end of the moving rod, and includes a gas exhaust on one side that is facing the stationary contact, and an opening on another side, the moving rod being inserted in the cylinder;

a stationary piston that is fitted into the opening of the cylinder and fixed on the second side of the container, and creates a puffer chamber inside the cylinder;

a moving piston that is fitted in the puffer chamber and divides the puffer chamber into a first puffer chamber and a second puffer chamber on stationary piston side, and slides according to a difference in pressure in the first puffer chamber and the second puffer chamber; and a stopper arranged to regulate sliding distance of the moving piston from the first side, wherein the first puffer chamber functioning as a thermal puffer chamber at a large interruption current to blow the arc-extinguishing gas on the arc through a gas exhaust of the first puffer chamber due to a pressure rise caused by a thermal expansion of the gas in the first puffer chamber, and functioning as a mechanical puffer chamber at a small interruption current to blow the arc-extinguishing gas on the arc through the gas exhaust of the first puffer chamber due to a mechanical pressure of the stationary piston.

2. The gas-circuit breaker according to claim 1, wherein an insulation nozzle being shaped like a funnel, includes a wider mouth part fixed to one end of the cylinder and a narrow part with the stationary arc-contact being inserted into, the stationary arc-contacts and the moving arc-contacts being set inside the funnel shape, becomes an arc extinguishing chamber in which the gas is blasted in from the gas exhausts.

* * * * *